United States Patent [19]

Bishop, Jr.

[11] 4,410,359

[45] Oct. 18, 1983

[54] PROCESS FOR PRODUCTION OF STAINLESS STEEL

[75] Inventor: Harry L. Bishop, Jr., Pittsburgh, Pa.

[73] Assignee: Allegheny Ludlum Steel Corporation, Pittsburgh, Pa.

[21] Appl. No.: 414,546

[22] Filed: Sep. 3, 1982

[51] Int. Cl.[3] ..... C21C 5/34

[52] U.S. Cl. ..... 75/49; 75/51; 75/52; 75/59; 75/60; 75/130.5

[58] Field of Search ..... 75/49, 51, 52, 59, 60, 75/130.5

[56] References Cited

U.S. PATENT DOCUMENTS

| | | | |
|---|---|---|---|
| 3,046,107 | 7/1962 | Nelson | 75/59 |
| 3,854,932 | 12/1974 | Bishop, Jr. | 75/49 |
| 4,154,602 | 5/1979 | Kaito et al. | 75/49 |
| 4,154,603 | 5/1979 | Oguchi et al. | 75/49 |
| 4,168,158 | 9/1979 | Iwaoka et al. | 75/60 |
| 4,170,467 | 10/1979 | Kaito et al. | 75/49 |

*Primary Examiner*—P. D. Rosenberg

*Attorney, Agent, or Firm*—Patrick J. Viccaro

[57] ABSTRACT

A process for the production of stainless steel in a top blown oxygen converter wherein the rate of carbon removal during the refining process is improved particularly from the standpoint of minimizing oxidation of other alloying elements such as chromium. This is achieved by introducing oxygen mixed with an inert gas through a tuyere and into the metal being refined either simultaneously during a portion of the oxygen blowing or after the completion of oxygen blowing but in any case it is continued until the required carbon level has been achieved, while the interior of the converter above the liquid level is maintained at subatmospheric pressure.

6 Claims, No Drawings

PROCESS FOR PRODUCTION OF STAINLESS STEEL

BACKGROUND OF THE INVENTION

This invention relates to an oxygen blowing process for the production of steel. More particularly, the invention relates to a top oxygen blowing process for reducing carbon levels in the production of stainless steel.

It is known to produce stainless steel in a top blown oxygen converter wherein substantially pure oxygen is blown through a lance onto the surface of a chromium-containing iron bath maintained in a converter vessel. The oxygen introduced from the lance and onto the bath surface reacts with carbon, chromium, iron and oxidizes these as well as other elements in the molten iron charge in the converter. The thermodynamics of the system determines the oxygen compounds formed and the refining operation is controlled to promote the reaction of oxygen with carbon in preference to valuable alloying constituents such as chromium. To promote the reaction of oxygen with carbon, it is known to introduce oxygen below the surface of the charge through a tuyere in the bottom of the converter so that the bubbles of oxygen are distributed throughout the melt; and therefore oxygen is available to the carbon throughout the melt. It is also known that when refining with the converter at atmospheric pressure, it is helpful to introduce mixtures of oxygen and inert gas through a tuyere so that the bubbles will not become too concentrated with carbon oxides as these reactions proceed. It is also known that the oxygen is introduced through a lance in the top so that the oxygen impinges onto or beneath the surface of the bath, and an inert or endothermic gas is introduced through a tuyere in the bottom of the converter, while the interior of the vessel is at subatmospheric pressure as practiced in U.S. Pat. No. 3,854,932 which is incorporated herein by reference as if fully set forth herein.

SUMMARY OF THE INVENTION

In accordance with the present invention a process is provided for producing stainless steel in a top blown oxygen converter comprising while maintaining a subatmospheric pressure in a converter vessel, blowing oxygen through a lance onto or beneath the surface of a molten charge within the vessel, and simultaneously, during the oxygen blowing introducing an inert gas or endothermic gas through a tuyere in the bottom section of the converter and into the charge. When the carbon content of the charge is decreased to less than about 0.10%, oxygen is introduced mixed with the inert gas through the tuyere and into the charge until carbon is reduced to the required level. After the mixed gas blowing through the tuyere(s), the inert gas may continue to be introduced without oxygen to further reduce the carbon content.

To improve the kinetics of carbon removal for stainless steel heats at low carbon contents, of less than 0.03% C, and especially to less than 0.005%, it is advantageous to introduce mixtures of oxygen and inert gas through a tuyere in the bottom of the vessel for final decarburization, while the interior of the converter above the liquid level is maintained at subatmospheric level.

It is accordingly a primary object of the present invention to provide an improvement on the top blown oxygen converter process wherein mixtures of oxygen and an inert gas may be introduced through the tuyeres in combination with conventional top blown oxygen from a lance, and maintaining a subatmospheric pressure within the converter, to increase the rate of carbon removal to less than 0.03% C, i.e., less than 0.01% C, in the production of stainless steel while minimizing oxidation of chromium and other valuable alloying constituents and controlling the temperature of the molten metal being refined.

This and other objects of the invention, as well as a more complete understanding thereof, may be obtained from the following description and specific examples.

DETAILED DESCRIPTION OF THE PREFERRED EMBODIMENTS

Broadly in the practice of the invention a metal charge to be refined is introduced to a top blown oxygen converter. The metal charge has a chromium content as well as other desired alloying elements suitable for the production of stainless steel. Although a liquid charge is generally referred to, the charge may be a mixture of liquid and solid material. The converter is adapted with at least one tuyere adjacent the bottom section thereof to permit the introduction of inert gas, such as argon or nitrogen, and oxygen mixed with an inert gas, into the molten metal charge near the bottom of the converter vessel. Though "inert gas" may be referred to herein, the gas may be an endothermic gas. Apparatus suitable for this purpose is shown and described in U.S. Pat. No. 3,854,932.

Initially during refining, oxygen is blown through a lance and onto or beneath the surface of the molten charge within the converter vessel. In accordance with the improvement of the invention, during the initial stage of oxygen blowing there is simultaneously introduced an inert gas through the tuyere and into the charge, with a subatmospheric pressure within the converter. When the carbon content of the charge has decreased during refining to less than about 0.10% by weight of the charge, oxygen is mixed with the inert gas being introduced through the tuyere(s) and this oxygen-inert gas mixture is introduced until the required carbon level in the charge is achieved. Preferably, oxygen blowing through the lance is discontinued when the oxygen-inert gas mixture is being introduced through the tuyere and into the charge. Also, preferably the oxygen-inert gas mixture is introduced when the carbon content of the charge has been reduced to less than about 0.03% by weight. The ratio of oxygen-to-inert gas in the mixture is within the range of 2:1 to 1:10, depending on the chromium content and temperature of the bath, and final carbon content desired. Thereafter, in the conventional manner the resulting stainless steeel is removed from the converter.

Preferably, in accordance with the invention, if the initial temperature of the charge is below the carbon-oxygen reaction temperature, the ratio of oxygen-to-inert gas introduced through the tuyeres is increased to oxidize a portion of the charge sufficient to raise the charge temperature to above the carbon-oxygen reaction temperature. This facilitates carbon removal preferentially to other valuable alloying constituents, such as chromium. In addition, in accordance with the invention, the ratio of oxygen mixed with inert gas introduced through the tuyere is decreased in proportion to the decrease in the carbon content of the charge.

The converter is maintained at subatmospheric pressure during the refining process in accordance with the invention. This is achieved conventionally by means such as a sealed hood and providing a forced exhaust system capable of removing gaseous reaction products and inert gas at a rate sufficient to maintain the desired subatmospheric pressure. Preferably, the pressure will be progressively decreased as the refining process continues. Pressures of at most 200 mm Hg will be maintained but lower pressures will frequently be required depending upon the final alloy chemistry desired. The typical charge of molten iron to the converter would contain carbon within the range of 0.5 to 4% with chromium up to 35% and possibly nickel up to 80%.

In a typical example of the practice of the invention the process thereof could be employed to produce a stainless steel having a composition, in percent by weight, of maximum 0.005% carbon, less than 2% manganese, 0.1 to 1.0% silicon, 11 to 30% chromium, 0 to 25% nickel and maximums of 0.030% phosphorus and 0.030% sulfur with the balance iron. The process is initiated by tilting a converter vessel of the conventional top blown oxygen type and charging it with 200,000 pounds of molten metal of a composition consisting of 1.5% carbon, 0.5% manganese, 0.025% phosphorus,0.015% sulfur, 0.3% silicon, 30.0% chromium, 0.15% nickel and the balance iron. When the charging of the converter is finished, the vessel is rotated to a vertical position and the hood engages the top of the vessel to create a seal capable of holding a vacuum. The lance is lowered to a height of 25 to 40 inches above the surface of the bath and the vacuum system is operated and oxygen is blown through the top lance at a rate of about 1200 scfm, depending on the vacuum pumping capacity. The vacuum system is operated so that the pressure within the converter is about 200 mm Hg when starting the oxygen blow. Oxygen blowing through the lance is decreased during the oxygen low from 1200 scfm down to 600 scfm as the converter pressure decreases from 200 mm Hg down to less than 10 mm Hg to achieve a carbon content of 0.10%. During this period, an inert gas is introduced through the bottom tuyere at a rate of about 400 scfm. Upon achieving this carbon content, oxygen is introduced through the tuyeres and into the charge at a rate of about 600 scfm, resulting in mixed gas blowing with $O_2/Ar$ ratio of 1.5:1. This $O_2Ar$ ratio is continued until 0.03% C is achieved, at which time the gas mixture is changed to 1:3, and then 1:9, depending upon the final carbon content desired, and chromium content and temperature of the bath. During the period of mixed gas blowing, the pressure within the vessel is less than 10 mm Hg, and preferably decreasing to less than 2 mm Hg as the carbon content decreases to less than 0.01%. The total mixed gas flow rate is also decreased as the pressure decreases, depending on the capacity of the vacuum pumping system. Typically, the total mixed gas flow rate through the tuyere is decreased to about 200 to 300 scfm. When the carbon is reduced to the desired level, the mixed gas blowing may be discontinued, and inert gas blowing resumed to further reduce the carbon levels. By the method of the present invention, relatively low volumes of argon are used, typically in the range of 150–250 scf/ton of steel refined or even lower volumes.

While several embodiments of the invention have been shown and described, it will be apparent to those skilled in the art that modifications may be made without departing from the scope of the present invention.

What is claimed is

1. A process for producing stainless seel in a top blown oxygen converter having an oxygen lance adapted to introduce oxygen to the surface of a chromium-containing molten charge of a composition slightly higher than desired in the stainless steel to be produced and contained within a converter vessel, said vessel including a bottom section having a tuyere, said method comprising while maintaining a subatmospheric pressure in said converter vessel blowing oxygen through said lance and onto or beneath the surface of said charge within said converter vessel, during said oxygen blowing simultaneously introducing an inert gas through said tuyere and into said charge, when the carbon content of said charge is decreased to less than about 0.10% by weight introducing oxygen mixed with said inert gas through said tuyere and into said charge until carbon has been reduced to the required level in said charge and removing stainless steel from said converter vessel.

2. The method of claim 1 wherein said oxygen blowing through said lance is discontinued while oxygen mixed with said inert gas is being introduced through said tuyere and into said charge.

3. The method of claim 2 wherein when the carbon content of said charge is decreased to less than about 0.03% by weight, oxygen mixed with inert gas is introduced through said tuyere and into said charge.

4. The method of claims 1, 2 or 3 wherein the ratio of oxygen mixed with inert gas is within the range of 2:1 to 1:10.

5. The method of claim 4 wherein if the temperature of said charge is below the carbon-oxygen reaction temperature, the ratio of oxygen-to-inert gas is increased to oxidize a portion of said charge sufficient to raise the charge temperature to above the carbon-oxygen reaction temperature to permit further decrease in the carbon content of said charge.

6. The method of claim 4 wherein the ratio of oxygen mixed with inert gas is decreased in proportion to decreases in the carbon content of said charge.

* * * * *